US008936893B2

(12) United States Patent
Tyagi et al.

(10) Patent No.: US 8,936,893 B2
(45) Date of Patent: Jan. 20, 2015

(54) FLUORESCING YELLOW TONER PARTICLES AND METHODS OF USE

(71) Applicants: Dinesh Tyagi, Fairport, NY (US); Chung-Hui Kuo, Fairport, NY (US); Louise Granica, Victor, NY (US)

(72) Inventors: Dinesh Tyagi, Fairport, NY (US); Chung-Hui Kuo, Fairport, NY (US); Louise Granica, Victor, NY (US)

(73) Assignee: Eastman Kodak Company, Rochester, NY (US)

( * ) Notice: Subject to any disclaimer, the term of this patent is extended or adjusted under 35 U.S.C. 154(b) by 15 days.

(21) Appl. No.: 13/837,043

(22) Filed: Mar. 15, 2013

(65) Prior Publication Data

US 2014/0272339 A1 Sep. 18, 2014

(51) Int. Cl.
*G03G 9/09* (2006.01)

(52) U.S. Cl.
CPC ..... *G03G 9/0926* (2013.01)
USPC ..... 430/107.1; 430/108.1

(58) Field of Classification Search
CPC ... G03G 9/09; G03G 9/0918; G03G 9/08755; G03G 9/08797; G03G 9/0819
USPC ..... 430/107.1, 108.1
See application file for complete search history.

(56) References Cited

U.S. PATENT DOCUMENTS

| | | | | |
|---|---|---|---|---|
| 3,713,861 | A | 1/1973 | Sharp | |
| 5,105,451 | A | 4/1992 | Lubinsky et al. | |
| 5,387,264 | A * | 2/1995 | Murakami et al. | 8/648 |
| 5,910,388 | A | 6/1999 | Ray et al. | |
| 6,040,482 | A * | 3/2000 | Harris et al. | 564/443 |
| 6,664,017 | B1 | 12/2003 | Patel et al. | |
| 2010/0164218 | A1 | 7/2010 | Schulze-Hagenest et al. | |
| 2011/0151367 | A1 | 6/2011 | Haruki et al. | |
| 2011/0159424 | A1 * | 6/2011 | Choi et al. | 430/107.1 |

FOREIGN PATENT DOCUMENTS

| | | |
|---|---|---|
| EP | 1 521 128 A2 | 4/2005 |
| JP | 10-107970 | 4/1998 |
| JP | 2002-082582 | 3/2002 |
| JP | 2004-348539 | 12/2004 |

OTHER PUBLICATIONS

U.S. Appl. No. 13/836,491, filed Mar. 15, 2013 by Dinesh Tyagi, et al., titled Highlighting Color Toner Images With Fluorescing Toners.
U.S. Appl. No. 13/837,546, filed Mar. 15, 2013 by Dinesh Tyagi, et al., titled Use of Fluorescing Toners for Imaging.
U.S. Appl. No. 13/873,540, filed Apr. 30, 2013 by Dinesh Tyagi, et al. titled Preparing Color Toner Images With Metallic Effect.
U.S. Appl. No. 13/462,133, "Use of Fluorescing Toners for Imaging," by Tyagi et al., filed May 2, 2012.
U.S. Appl. No. 13/462,182, "Enhancing Color Toner Images With Fluorescing Magenta Toners," by Tyagi et al., filed May 2, 2012.
U.S. Appl. No. 13/462,155, "Highlighting Color Toner Images With Fluorescing Toners," by Tyagi et al., filed May 2, 2012.
U.S. Appl. No. 13/462,111, "Preparing Color Toner Images With Metallic Effect," by Tyagi et al., filed May 2, 2012.

* cited by examiner

*Primary Examiner* — Hoa V Le
(74) *Attorney, Agent, or Firm* — J. Lanny Tucker

(57) ABSTRACT

A fluorescing yellow polymeric toner particle comprises one or more non-fluorescing yellow colorants, and one or more fluorescing yellow colorants having one or more emission peak wavelengths of at least 480 nm and up to and including 600 nm. These fluorescing yellow polymeric toner particles can be used to provide multicolor toner images with increased yellow color gamut.

8 Claims, 1 Drawing Sheet

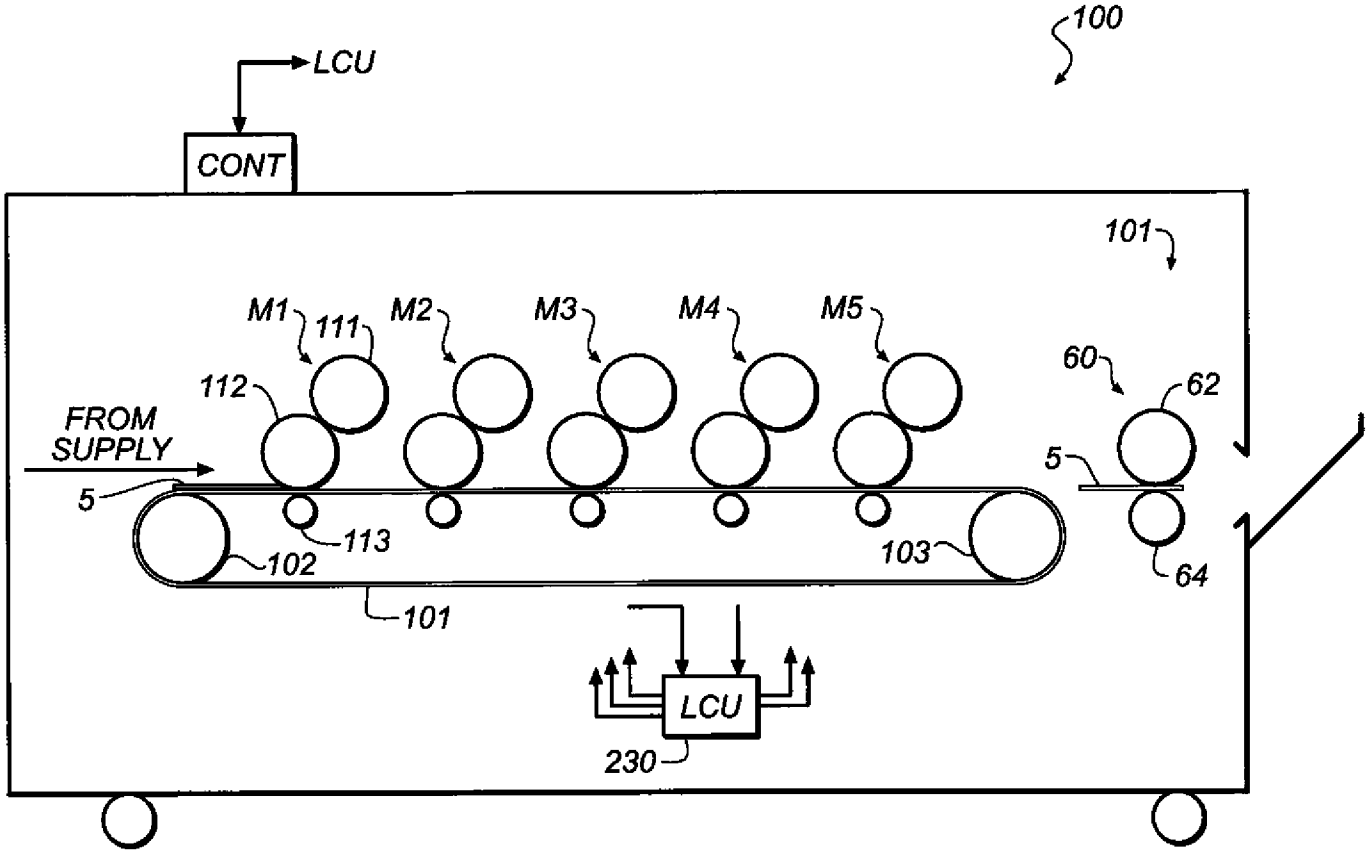
100
LCU
CONT
101
M1
111
112
M2
M3
M4
M5
113
102
FROM SUPPLY
5
103
101
60
62
64
5
LCU
230

FLUORESCING YELLOW TONER PARTICLES AND METHODS OF USE

FIELD OF THE INVENTION

This invention relates to fluorescing yellow polymeric toner particles having enhanced yellow colors because of the presence of fluorescing yellow colorants, and to methods for using them.

BACKGROUND OF THE INVENTION

One common method for printing images on a receiver material is referred to as electrophotography. The production of black-and-white or color images using electrophotography generally includes the producing a latent electrostatic image by uniformly charging a dielectric member such as a photoconductive substance, and then discharging selected areas of the uniform charge to yield an imagewise electrostatic charge pattern. Such discharge is generally accomplished by exposing the uniformly charged dielectric member to actinic radiation provided by selectively activating particular light sources in an LED array or a laser device directed at the dielectric member. After the imagewise charge pattern is formed, it is "developed" into a visible image using pigmented or non-pigmented marking particles (generally referred to as "toner particles") by either using the charge area development (CAD) or the discharge area development (DAD) method that have an opposite charge to the dielectric member and are brought into the vicinity of the dielectric member so as to be attracted to the imagewise charge pattern.

Thereafter, a suitable receiver material (for example, a cut sheet of plain bond paper) is brought into juxtaposition with the toner image developed with the toner particles in accordance with the imagewise charge pattern on the dielectric member, either directly or using an intermediate transfer member. A suitable electric field is applied to transfer the toner particles to the receiver material in the imagewise pattern to form the desired print image on the receiver material. The receiver material is then removed from its operative association with the dielectric member and subjected to suitable heat or pressure or both heat and pressure to permanently fix (also known as fusing) the toner image (containing toner particles) to form the desired image on the receiver material.

Plural toner particle images of, for example, different color toner particles respectively, can be overlaid with multiple toner transfers to the receiver material, followed by fixing of all toner particles to form a multi-color image in the receiver material. Toners that are used in this fashion to prepare multicolor images are generally Cyan (C), Yellow (Y), Magenta (M), and Black (K) toners containing appropriate dyes or pigments to provide the desired colors or tones.

It is also known to use special spot toners to provide additional colors that cannot be obtained by simply mixing the four "primary" toners. An example is a specially designed toner that provides a color spot or pearlescent effect.

With the improved print image quality that is achieved with the more recent electrophotographic technology, print providers and customers alike have been looking for ways to expand the use of images prepared using electrophotography. Printing processes serve not only to reproduce and transmit objective information but also to convey esthetic impressions, for example, for glossy books or pictorial advertizing.

The desire to provide fluorescing effects has existed for several decades and U.S. Pat. No. 3,713,861 (Sharp et al.) describes coating a fluorescent material over a document image.

Many color images cannot be reproduced using the traditional CYMK color toners. Specifically, fluorescing colors or tones cannot be readily reproduced using the CYMK color toner set. It has been proposed to incorporate fluorescing pigments or dyes into liquid toner particles as described in U.S. Pat. No. 5,105,451 (Lubinsky et al.).

U.S. Patent Application Publication 2010/0164218 (Schulze-Hagenest et al.) describes the use of substantially clear (colorless) fluorescent toner particles in printing methods over color toner images. Such clear fluorescent toner particles can be used for security purposes since they are not colored except when excited with appropriate light. Other invisible fluorescent pigments for toner images are described in U.S. Pat. No. 6,664,017 (Patel et al.).

Printing processes for providing one or more color toner images are known, but it is also desired that fluorescing effects can also be provided for any type of color toner image in order to expand the color gamut while using conventional non-fluorescing color toners. However, it has been difficult to properly design desired fluorescing effects using known fluorescing colorants (dyes and pigments) as many of them are very sensitive to the illuminating radiation. Further, the color reproduction using fluorescing color toners produces unrealistically "bright" colors for most objects. This is usually an undesirable effect.

When illuminating light has some portion of the electromagnetic spectrum that is absorbed by fluorescing colorants that emit at a different wavelength, the overall resulting emissions are very "bright" and may overwhelm the non-fluorescing traditional colors in the color toner images. This again results in unrealistic images. Other illuminating light may not have substantial radiation that is absorbed, and the resulting emission from the fluorescing colorants is quite different. It is undesirable to have the fluorescing effects depend upon the illuminating light since constantly changing emissions and effects would reduce consistency in the resulting color image tone and discourage customers from using the fluorescing effects. This is often referred to as illuminant sensitivity and is not a desirable effect.

Typical electrophotographic toners and imaging procedures offer a limited color gamut (or ability to provide varying colors using the same set of toner particles). This is especially true in the yellow portion of the color space because of the inability of typical yellow hues to replicate some light and pale yellow hues, green hues, and orange hues.

While it is known to use fluorescent colors (for example, fluorescent toner particles) can be used to provide vibrant and colorful images, as suggested in the publications cited above. Copending and commonly assigned U.S. Ser. No. 13/462,133 (filed May 2, 2012 by Tyagi and Granica) describes unique fluorescing yellow polymeric toner particles and their use to provide fluorescent highlights in electrophotographic toner images. Various fluorescing polymeric toner particles are also described in various imaging methods in copending and commonly assigned U.S. Ser. No. 13/462,182 (filed May 2, 2012 by Tyagi, Granica, and Kuo), Ser. No. 13/462,155 (filed May 2, 2012 by Tyagi and Granica), and Ser. No. 13/462,111 (filed May 2, 2012 by Tyagi, Lofftus, Granica, and Allen).

While such fluorescing yellow polymeric toner particles are useful to provide enhanced or highlighted toner images, there remains a need to expand the possible color gamut with fluorescing effects and to provide more natural or realistic colors used in some printing jobs, especially in 4 color CYMK imaging processes.

SUMMARY OF THE INVENTION

This invention provides a fluorescing yellow polymeric toner particle comprising a polymeric binder phase, and having distributed therein:

one or more non-fluorescing yellow colorants having one or more absorbance peak wavelengths of at least 480 nm to and including 600 nm, and one or more fluorescing yellow colorants having one or more emission peak wavelengths of at least 480 nm to and including 600 nm, wherein the molar ratio of the one or more fluorescing yellow colorants to the one or more non-fluorescing yellow colorants is such that the covering power of the fluorescing yellow polymeric toner particle is greater than the covering power of non-fluorescing yellow polymeric toner particles having the same composition and size except that the one or more fluorescing yellow colorants are absent.

In some embodiments of this invention, a fluorescing yellow polymeric toner particle comprises a polymeric binder phase, and has distributed therein:

one or more non-fluorescing yellow colorants having one or more absorbance peak wavelengths of at least 480 nm to and including 600 nm, and one or more fluorescing yellow colorants having one or more emission peak wavelengths of at least 480 nm to and including 600 nm, wherein the molar ratio of the one or more fluorescing yellow colorants to the one or more non-fluorescing yellow colorants is such that the L* value of the one or more non-fluorescing yellow colorants, when present in a non-fluorescing yellow polymeric toner particle comprising the same polymeric binder phase, is increased by at least 50% in the presence of the one or more non-fluorescing yellow colorants in the fluorescing yellow polymeric toner particle.

The present invention also provides two-component developers, each two-component developer comprising carrier particles and one or more of the fluorescing yellow polymeric toner particles of the present invention.

In addition, a method of this invention for providing an enhanced yellow toner image, comprises:

providing fluorescing yellow polymeric toner particles on a receiver material to provide a fluorescing yellow toner image, fixing the fluorescing yellow toner image to the receiver material to form a fixed fluorescing yellow toner image, wherein each fluorescing yellow polymeric toner particle comprises a polymeric binder phase, and has distributed therein:

one or more non-fluorescing yellow colorants having one or more absorbance peak wavelengths of at least 480 nm and up to and including 600 nm, and one or more fluorescing yellow colorants having one or more emission peak wavelengths of at least 480 nm and up to and including 600 nm, wherein the molar ratio of the one or more fluorescing yellow colorants to the one or more non-fluorescing yellow colorants is such that the covering power of the fluorescing yellow polymeric toner particle is greater than the covering power of non-fluorescing yellow polymeric toner particles having the same composition and size except that the one or more fluorescing yellow colorants are absent.

In addition, a method for providing an enhanced yellow toner image, the method of this invention comprising:

developing a latent image with fluorescing yellow polymeric toner particles to form a fluorescing yellow toner image on a first receiver material, transferring the fluorescing yellow toner image from the first receiver material to a final receiver material to form a transferred fluorescing yellow toner image, and fixing the transferred fluorescing yellow toner image to the final receiver material to form a fixed fluorescing yellow toner image, wherein each fluorescing yellow polymeric toner particle comprises a polymeric binder phase, and has distributed therein:

one or more non-fluorescing yellow colorants having one or more absorbance peak wavelengths of at least 480 nm to and including 600 nm, and one or more fluorescing yellow colorants having one or more emission peak wavelengths of at least 480 nm to and including 600 nm, wherein the molar ratio of the one or more fluorescing yellow colorants to the one or more non-fluorescing yellow colorants is such that the covering power of the fluorescing yellow polymeric toner particle is greater than the covering power of non-fluorescing yellow polymeric toner particles having the same composition and size except that the one or more fluorescing yellow colorants are absent.

In some embodiments of the method of this invention, the method comprises:

forming one or more latent images, developing the one or more latent images, to form a fluorescing yellow toner image using the fluorescing particles of this invention, non-fluorescing cyan toner image, non-fluorescing magenta toner image, and non-fluorescing black toner image, to form a composite fluorescing color toner image, transferring the composite fluorescing color toner image to the final receiver material to form a transferred composite fluorescing color toner image, and fixing the transferred composite fluorescing color toner image to the receiver material.

The present invention also provides a printed receiver material provided by any method of the present invention, the printed receiver material comprising a printed fluorescing yellow color toner image comprising fused fluorescing yellow polymeric toner particles of this invention, each fluorescing yellow polymeric toner particle comprising a polymeric binder phase, and having distributed therein:

one or more non-fluorescing yellow colorants having one or more absorbance peak wavelengths of at least 480 nm to and including 600 nm, and one or more fluorescing yellow colorants having one or more emission peak wavelengths of at least 480 nm to and including 600 nm, wherein the molar ratio of the one or more fluorescing yellow colorants to the one or more non-fluorescing yellow colorants is such that the covering power of the fluorescing yellow polymeric toner particle is greater than the covering power of non-fluorescing yellow polymeric toner particles having the same composition and size except that the one or more fluorescing yellow colorants are absent.

The unique fluorescing yellow polymeric toner particles and the method of the present invention, provide bright yellow colors that can be used to provide higher color gamut in a wider variety of printing jobs. The improvement is provided by blending both at least one fluorescing yellow colorant and at least one non-fluorescing yellow colorant in the same polymeric toner particle. This blending of yellow colorants creates a "bright" yellow and it enables the formulator to adjust the brightness by adjusting the ratio of fluorescing yellow colorants and non-fluorescing yellow colorants. Not only can a larger yellow color gamut be created but the natural yellow colors can also be maintained without using a separate yellow color toner station. It is also possible for a toner printer to use the fluorescing yellow toner particles of this invention as the sole yellow toner particles, or to use them in mixture with or in addition to, non-fluorescing yellow toner particles, in the same or different toner station.

Thus, the present invention provides surprisingly new yellow color effects that can open a much wider gamut of yellow color image options for various purposes, and this wider yellow color gamut can be identified and defined using various L*, a*, b* color scale (CIELAB 1976) designations for identifying colors.

BRIEF DESCRIPTION OF THE DRAWING

FIG. 1 is schematic side elevational view, in cross section, of a typical electrophotographic reproduction apparatus (printer) suitable for use in the practice of the present invention.

DETAILED DESCRIPTION OF THE INVENTION

Definitions

As used herein to define various components of the fluorescing and non-fluorescing yellow colorants, polymeric binders, non-fluorescing cyan, non-fluorescing magenta, and non-fluorescing black colorants, and other components, unless otherwise indicated, the singular forms "a", "an", and "the" are intended to include one or more of the components (that is, including plurality referents).

Each term that is not explicitly defined in the present application is to be understood to have a meaning that is commonly accepted by those skilled in the art. If the construction of a term would render it meaningless or essentially meaningless in its context, the term's definition should be taken from a standard dictionary.

The use of numerical values in the various ranges specified herein, unless otherwise expressly indicated otherwise, are considered to be approximations as though the minimum and maximum values within the stated ranges were both preceded by the word "about". In this manner, slight variations above and below the stated ranges can be used to achieve substantially the same results as the values within the ranges. In addition, the disclosure of these ranges is intended as a continuous range including every value between the minimum and maximum values.

The terms "particle size", "size", and "sized" as used herein in reference to toner particles, including the fluorescing yellow toner particles of this invention, are defined in terms of the mean volume weighted diameter ($D_{vol}$, in μm) as measured by conventional diameter measuring devices such as a Coulter Multisizer (Coulter, Inc.). The mean volume weighted diameter is the sum of the mass of fluorescing yellow polymeric toner particle multiplied by the diameter of a spherical particle of equal mass and density, divided by the total fluorescing yellow polymeric toner particle mass. The non-fluorescing toner particles can be similarly sized.

"Equivalent circular diameter" (ECD) may be used herein to define the size (for example, in μm) some particles described herein, and it represents the diameter of a circle that has essentially the same area as a particle projected image when the particle is lying flat to the field of view. This allows irregularly shaped particles as well as spherical particles to be measured using the same parameter. Techniques for measuring ECD are known in the art.

The term "electrostatic printing process" as used herein refers to printing methods including but not limited to, electrophotography and direct, solid dry toner printing as described herein.

The term "color" as used herein refers to color toner particles containing one or more colorants (dyes or pigments) that provide a color or hue having an optical density of at least 0.2 at the maximum exposure so as to distinguish them from "colorless" polymeric toner particles that have a lower optical density.

By non-fluorescing colorants, it is meant that the colorants do not emit light or "fluoresce" upon exposure to radiation of a different wavelength to a significant degree.

L*, a*, and b* color parameters are known in the art as defined in CIELAB 1976 color space as described in CIE Publication 15.2 (1986). The parameter L* defines "lightness" (white=100 to black=0), and a* and b* define color hues (positive a* is red, negative a* is green, positive b* is yellow and negative b* is blue).

The term "fluorescing yellow" refers to a colorant, polymeric toner particle, or toner image that provides a color or hue having an optical density of at least 0.2 at the maximum exposure to irradiating light, so as to distinguish it from "colorless" or "substantially clear" fluorescing colorants, toner particles, or toner images as described for example in U.S. Patent Application Publication 2010/0164218 (noted above). At least one of the "fluorescing yellow" colorants in the fluorescing yellow toner particles of this invention emit as one or more emission peak wavelengths of at least 480 nm and up to and including 600 nm, and particular at one or more emission peak wavelengths of at least 480 nm and up to and including 580 nm, when exposed to radiation of (excited by) a different wavelength (for example, below 480 nm or typically below 460 nm).

The term "emission peak wavelength" in reference to the fluorescing yellow colorants in the fluorescing yellow polymeric toner particles means an emission peak within the noted range of wavelengths that provides the desired fluorescing yellow effect according to this invention. There can be multiple peak wavelengths for a given fluorescing yellow colorant. It is not necessary that every $\lambda_{max}$ of a particular fluorescing yellow colorant be within the noted range of wavelengths or that the peak wavelength of interest be the $\lambda_{max}$. However, many useful fluorescing yellow colorants will have a $\lambda_{max}$ within the noted range of wavelengths and this $\lambda_{max}$ can also be the desired "peak" wavelength.

The term "absorbance peak wavelength" in reference to the non-fluorescing yellow and other non-fluorescing colorants refers to a wavelength within the noted range where the colorant prominently absorbs and reflects radiation, usually in the visible range of the electromagnetic spectrum.

Unless otherwise indicated, the terms "fluorescing yellow polymeric toner particles" and "fluorescing yellow toner particles" refer to toner particles within the scope of the present invention.

The term "composite", when used in reference to developed color toner images or developed and fixed color toner images, refers to the combination of at least 2 (for example, CY) and up to and including 5 (for example, KYMCY), color toner images in the same multicolor toner image. The "Y" can be either fluorescing yellow, non-fluorescing yellow, or both, as long as one yellow color toner image is fluorescing yellow according to this invention.

The term "covering power" refers to the coloring strength (optical density) value of fixed polymeric toner particles on a specific receiver material, or the ability of the fixed polymeric toner particles to "cover" or hide radiation reflected from the receiver material. For example, covering power values can be determined by making patches of varying densities from non-fixed polymeric toner particles on a receiver material such as a clear film. The weight and area of each of these patches is measured, and the polymeric toner particles in each patch are fixed for example in an oven with controlled temperature that is hot enough to melt the polymeric toner particles sufficiently to form a continuous thin film in each patch on the receiver material. The transmission densities of the resulting patches of thin films are measured with a Status A blue filter on an X-rite densitometer (other conventional densitometers can be used). A plot of the patch transmission densities vs. initial patch polymeric toner weight is prepared, and the weight per unit area of toner thin film is calculated at a transmission density of 1.0. The reciprocal of this value, in units of $cm^2/g$ of fixed polymeric toner particles, is the "covering power". Another way of saying this is that the covering power is the area of the receiver material that is covered to a transmission density of 1.0 by 1 gram of polymeric toner particles. As the covering power increases, the "yield" of the polymeric toner particles increases, meaning that less mass of polymeric toner particles is needed to create the same amount of density area coverage in a printed image on the receiver material. Thus, covering power is a measurement that is taken after the polymeric toner particles are fixed (or fused) to a given receiver material. A skilled worker would be able from this description to measure the covering power of any particular polymeric toner particles and composition (containing polymer binder, colorants, and optional addenda), receiver material, and fixing conditions as used in the practice of this invention.

Polymeric Toner Particles

The present invention comprises and uses fluorescing yellow polymeric toner particles and compositions of a plurality of such toner particles in developers (described below) that can be used for reproduction of a wide gamut of fluorescing yellow hues or effects by an electrostatic printing process, especially by an electrophotographic imaging process.

These fluorescing yellow polymeric toner particles can be porous or nonporous. For example, if they are porous particles, up to 60% of the volume can be occupied or unoccupied pores within the polymeric binder phase (matrix). The mixture of fluorescing yellow colorants and non-fluorescent yellow colorants can be within the pores, within the polymeric binder phase, or both. In many embodiments, the fluorescing yellow polymeric toner particles are not purposely designed to be porous although pores may be created unintentionally during manufacture. In such "nonporous" embodiments, the porosity of the fluorescing yellow polymeric toner particles is less than 10% based on the total dry particle volume within the external particle surface, and the mixture of fluorescing yellow colorants and non-fluorescing yellow colorants are predominantly (at least 90 weight %) in the polymeric binder phase.

Each fluorescing yellow polymeric toner particles has an external particle surface and comprises a polymeric binder phase and one or more fluorescing yellow colorants (described below) and one or more non-fluorescing yellow colorants (also described below) that are generally uniformly dispersed within the polymeric binder phase to provide, when fixed (or fused) and excited by appropriate radiation, the observable fluorescing yellow effects described herein.

As described in more detail below, these fluorescing yellow polymeric toner particles can be used for imaging in combination with non-fluorescing color (cyan, magenta, yellow, and black) toner particles that provide one or more non-fluorescing colors in a composite fluorescing color toner image.

Optional additives (described below) can be incorporated into the fluorescing yellow polymeric toner particles to provide various properties that are useful for electrostatic printing processes. However, only the polymeric binder phase, the one or more fluorescing yellow colorants, and the one or more non-fluorescing yellow colorants described herein are essential for providing the desired fluorescing yellow effects in a fixed fluorescing yellow toner image and for this purpose, they are the only essential components of the fluorescing yellow polymeric toner particles.

The polymeric binder phase is generally a continuous polymeric phase comprising one or more polymeric binders that are suitable for the various imaging methods described herein. Many useful binder polymers are known in the art as being suitable for forming dry toner particles as they will behave properly (melt and flow) during thermal fixing of the toner particles to a suitable receiver material. Such polymeric binders generally are amorphous and each has a glass transition temperature ($T_g$) of at least 50° C. and up to and including 100° C. In addition, the fluorescing yellow toner particles prepared from these polymeric binders have a caking temperature of at least 50° C. so that the fluorescing yellow polymeric toner particles can be stored for relatively long periods of time at fairly high temperatures without having individual particles agglomerate and clump together.

Useful polymeric binders for providing the polymeric binder phase include but are not limited to, polycarbonates, resin-modified malic alkyd polymers, polyamides, phenol-formaldehyde polymers and various derivatives thereof, polyester condensates, modified alkyd polymers, aromatic polymers containing alternating methylene and aromatic units, and fusible crosslinked polymers.

Other useful polymeric binders are vinyl polymers, such as homopolymers and copolymers derived from two or more ethylenically unsaturated polymerizable monomers. For example, useful copolymers can be derived one or more of styrene or a styrene derivative, vinyl naphthalene, p-chlorostyrene, unsaturated mono-olefins such as ethylene, propylene, butylene, and isobutylene, vinyl halides such as vinyl chloride, vinyl bromide, and vinyl fluoride, vinyl acetate, vinyl propionate, vinyl benzoate, vinyl butyrate, vinyl esters such as esters of mono carboxylic acids including acrylates and methacrylates, acrylonitrile, methacrylonitrile, acrylamides, methacrylamide, vinyl ethers such as vinyl methyl ether, vinyl isobutyl ether, and vinyl ethyl ether, N-vinyl indole, N-vinyl pyrrolidone, and others that would be readily apparent to one skilled in the electrophotographic polymer art.

For example, homopolymers and copolymers derived from styrene or styrene derivatives can comprise at least 40 weight % and up to and including 100 weight % of recurring units derived from styrene or styrene derivatives (homologs) and from 0 weight % and up to and including 40 weight % of recurring units derived from one or more lower alkyl acrylates or methacrylates (the term "lower alkyl" means alkyl groups having 1 to 6 carbon atoms). Other useful polymers include fusible styrene-acrylic copolymers that are partially crosslinked by incorporating recurring units derived from a divinyl ethylenically unsaturated polymerizable monomer such as divinylbenzene or a diacrylate or dimethacrylate. Polymeric binders of this type are described, for example, in U.S. Reissue Pat. No. 31,072 (Jadwin et al.) the disclosure of which is incorporated herein by reference. Mixtures of polymeric binders can be used if desired.

Some useful polymeric binders are derived from styrene or another vinyl aromatic ethylenically unsaturated polymerizable monomer and one or more alkyl acrylates, alkyl methacrylates, or dienes wherein the styrene recurring units comprise at least 60% by weight of the polymer. For example, copolymers that are derived from styrene and either butyl acrylate or butadiene are also useful as polymeric binders, or these copolymers can be part of blends of polymeric binders. For example, a blend of poly(styrene-co-butyl acrylate) and poly(styrene-co-butadiene) can be used wherein the weight ratio of the first polymeric binder to the second polymeric binder is from 10:1 to and including 1:10, or from 5:1 to and including 1:5.

Styrene-containing polymers are particularly useful and can be derived from one or more of styrene, α-methylstyrene, p-chlorostyrene, and vinyl toluene. Useful alkyl acrylates, alkyl methacrylates, and monocarboxylic acids that can be copolymerized with styrene or styrene derivatives include but are not limited to, acrylic acid, methyl acrylate, 2-ethylhexyl acrylate, 2-ethylhexyl methacrylate, ethyl acrylate, butyl acrylate, dodecyl acrylate, octyl acrylate, phenyl acrylate, methacrylic acid, ethyl methacrylate, butyl methacrylate, and octyl methacrylate.

Condensation polymers are also useful as polymeric binders in the fluorescing yellow polymeric toner particles. Useful condensation polymers include but are not limited to, polycarbonates, polyamides, polyesters, polywaxes, epoxy resins, polyurethanes, and polymeric esterification products of a polycarboxylic acid and a diol comprising a bisphenol. Particularly useful condensation polymeric binders include polyesters and copolyesters that are derived from one or more aromatic dicarboxylic acids and one or more aliphatic dials, including polyesters derived from isophthalic or terephthalic acid and dials such as ethylene glycol, cyclohexane dimethanol, and bisphenols (such as Bisphenol A). Other useful polyester binders can be obtained by the co-polycondensation polymerization of a carboxylic acid component comprising a carboxylic acid having two or more valencies, an acid anhydride thereof or a lower alkyl ester thereof (for example, fumaric acid, maleic acid, maleic anhydride, phthalic acid, terephthalic acid, trimellitic acid, or pyromellitic acid), using as a diol component a bisphenol derivative or a substituted compound thereof. Other useful polyesters are copolyesters prepared from terephthalic acid (including substituted terephthalic acid), a bis[(hydroxyalkoxy)phenyl]alkane having 1 to 4 carbon atoms in the alkoxy radical and from 1 to 10 carbon atoms in the alkane moiety (that can also be a halogen-substituted alkane), and an alkylene glycol having from 1 to 4 carbon atoms in the alkylene moiety. Specific examples of such condensation copolyesters and how they are made are provided for example in U.S. Pat. No. 5,120,631 (Kanbayashi et al.), U.S. Pat. No. 4,430,408 (Sitaramiah), and U.S. Pat. No. 5,714,295 (Wilson et al.), the disclosures of which are incorporated herein by reference for describing such polymeric binders. A useful polyester is a propoxylated bisphenol A fumarate.

Useful polycarbonates are described in U.S. Pat. No. 3,694,359 (Merrill et al.) that is incorporated by reference, which polycarbonates can contain alklidene diarylene moieties in recurring units.

Other specific polymeric binders useful in the fluorescing yellow polymeric toner particles are described in [0031] of U.S. Patent Application Publication 2011/0262858 (noted above) the disclosure of which is incorporated herein by reference.

In some embodiments, the polymeric binder phase comprises a polyester or a vinyl polymer derived at least in part from styrene or a styrene derivative and an acrylate (for example, a styrene-acrylate copolymer), both of which are described above.

In general, one or more polymeric binders are present in the fluorescing yellow polymeric toner particles in an amount of at least 50 weight % and up to and including 80 weight %, or typically at least 60 weight % and up to and including 75 weight %, based on the total fluorescing yellow polymeric dry toner particle weight.

The fluorescing yellow polymeric toner particles are not generally perfectly spherical so it is best to define them by the mean volume weighted diameter ($D_{vol}$) that can be determined as described above. Before fixing, the $D_{vol}$ can be at least 2 μm and up to and including 20 μm, typically at least 4 μm and up to and including 20 μm, or even at least 4 μm and up to and including 15 μm, but larger or smaller particles may be useful in certain embodiments. Some very small particles can be considered as "liquid" toner particles.

The fluorescing yellow colorants useful in the practice of this invention can be chosen from any of such pigments and dyes that are known in the art for having at least one emission peak wavelength of at least 480 nm and up to and including 600 nm, or at least 480 and up to and including 580 nm, when appropriately stimulated by exciting radiation typically below 480 nm or typically below 460 nm. Such compounds can be readily determined from such sources as Honeywell International (New Jersey), Union Pigment (Hongzhau, China), Dayglo Corporation (Ohio), Clariant Corporation (Rhode Island), H.W. Sands (Jupiter Fla.), Sun Chemicals (Ohio), and Risk Reactor (California). There is considerable published literature that provides suitable excitation wavelengths and emission wavelengths for given colorants.

For example, useful fluorescing yellow colorant classes include but are not limited to, coumarins, naphthalimides, perylenes, and anthrones. The non-fluorescing yellow colorants used in admixture with the fluorescing yellow colorants can be chosen from the same or different classes including but not limited to, coumarins, naphthalimides, perylenes, and anthrones.

In addition, the fluorescing yellow colorant can be attached to a suitable polymeric backbone, for example, as described in copending and commonly assigned U.S. Ser. No. 13/462,133 (filed May 2, 2012 by Tyagi and Granica), the disclosure of which is incorporated herein by reference.

The non-fluorescing yellow colorants useful in the present invention can be chosen from any of such materials that are known in the art, and for example, can be chosen from the same chemical classes as the fluorescing yellow colorants noted above. Such colorants can be chosen from any of such pigments and dyes that are known in the art for having at least one absorbance (or reflectance) peak wavelength of at least 480 nm and up to and including 600 nm, or at least 480 and up to and including 580 nm. The non-fluorescing yellow colorant can be provided in the form a masterbatch containing 30 weight % and up to and including 50 weight % of colorant in a polymeric matrix that is compatible with the toner polymer.

Mixtures of two or more of the fluorescing yellow colorants as described herein can be used if desired, and two or more non-fluorescing colorants can be used if desired. In all embodiments, one or more fluorescing yellow colorants are used in combination with one or more non-fluorescing yellow colorants in the fluorescing yellow polymeric toner particles.

The one or more fluorescing yellow colorants are generally present in the fluorescing yellow polymeric toner particles in an amount of at least 0.5 weight % and up to and including 40 weight %, or typically at least 2 weight % and up to and including 20 weight %, or at least 2 weight % and up to and including 12 weight %, based on the total fluorescing yellow polymeric toner particle dry weight.

The one or more non-fluorescing yellow colorants are generally present in the fluorescing yellow polymeric toner particles in an amount of at least 0.5 weight % and up to and including 40 weight %, or typically at least 2 weight % and up to and including 20 weight %, or at least 2 weight % and up to and including 12 weight %, based on the total fluorescing yellow polymeric toner particle dry weight.

However, the one or more fluorescing yellow colorants and the one or more non-fluorescing yellow colorants are generally present in different amounts. In general, the molar ratio of the one or more fluorescing yellow colorants to the one or more non-fluorescing yellow colorants is such that the covering power of the fluorescing yellow polymeric toner particles is greater than the covering power of the non-fluorescing yellow polymeric toner particles that have the same composition, size, and porosity, but do not contain the one or more fluorescing yellow colorants. In many embodiments, the covering power of the one or more fluorescing yellow polymeric toner particles to the covering power of the noted non-fluorescing yellow polymeric toner particles is at least 1:1 and to and including 10:1, or at least 2:1 and to and including 8:1. In many embodiments, the total amount of the one or more non-fluorescing yellow colorants is up to and including 40% of the total weight of the one or more fluorescing yellow colorants in the fluorescing yellow polymeric toner particles.

It is also possible to define the fluorescing yellow polymeric toner particles in term so L* value wherein the molar ratio of the one or more fluorescing yellow colorants to the one or more non-fluorescing colorants is such that the L* value of the one or more non-fluorescing colorants, when present in a non-fluorescing polymeric toner particle comprising the same polymeric binder phase, is increased by at least 50% in the presence of the one or more fluorescing yellow colorants in the fluorescing yellow polymeric toner particle.

Various optional additives that can be present in the fluorescing yellow polymeric toner particles can be added in the dry blend of polymeric resin particles and fluorescing yellow colorants and non-fluorescing yellow colorants as described herein. Such optional additives include but are not limited to, non-fluorescing non-yellow colorants, charge control agents, waxes, fuser release aids, leveling agents, surfactants, stabilizers, or any combinations of these materials. These additives are generally present in amounts that are known to be useful in the electrophotographic art as they are known to be used in other toner particles, including color toner particles.

In some embodiments, a spacing agent, fuser release aid, flow additive particles, or combinations of these materials can be provided on the outer surface of the fluorescing yellow polymeric toner particles, and such materials are provided in amounts that are known in the electrophotographic art. Generally, such materials are added to the fluorescing yellow polymeric dry toner particles after they have been prepared using the dry blending, melt extrusion, and breaking process (described below).

The non-fluorescing yellow colorants and fluorescing yellow colorants used in the practice of this invention can also be encapsulated using elastomeric resins that are included within the fluorescing yellow polymer toner particles. Such a process is described in U.S. Pat. No. 5,298,356 (Tyagi et al.) the disclosure of which is incorporated herein by reference.

Suitable charge control agents and their use in toner particles are well known in the art as described for example in the *Handbook of Imaging Materials*, 2nd Edition, Marcel Dekker, Inc., New York, ISBN: 0-8247-8903-2, pp. 180ff and references noted therein. The term "charge control" refers to a propensity of the material to modify the triboelectric charging properties of the fluorescing yellow polymeric toner particles. A wide variety of charge control agents can be used as described in U.S. Pat. No. 3,893,935 (Jadwin et al.), U.S. Pat. No. 4,079,014 (Burness et al.), U.S. Pat. No. 4,323,634 (Jadwin et al.), U.S. Pat. No. 4,394,430 (Jadwin et al.), U.S. Pat. No. 4,624,907 (Motohashi et al.), U.S. Pat. No. 4,814,250 (Kwarta et al.), U.S. Pat. No. 4,840,864 (Bugner et al.), U.S. Pat. No. 4,834,920 (Bugner et al.), and U.S. Pat. No. 4,780,553 (Suzuka et al.), the disclosures of all of which are incorporated herein by reference. The charge control agents can be transparent or translucent and free of pigments and dyes. Generally, these compounds are colorless or nearly colorless. Mixtures of charge control agents can be used. A desired charge control agent can be chosen depending upon whether positive or negative charging fluorescing yellow polymeric toner particles are needed.

Examples of useful charge control agents include but are not limited to, triphenylmethane compounds, ammonium salts, aluminum-azo complexes, chromium-azo complexes, chromium salicylate organo-complex salts, azo-iron complex salts, an azo-iron complex salt such as ferrate (1-), bis[4-[5-chloro-2-hydroxyphenyl)azo]-3-hydroxy-N-phenyl-2-naphthalene-carboxamidato(2-)], ammonium, sodium, or hydrogen (Organoiron available from Hodogaya Chemical Company Ltd.). Other useful charge control agents include but are not limited to, acidic organic charge control agents such as 2,4-dihydro-5-methyl-2-phenyl-3H-pyrazol-3-one (MPP) and derivatives of MPP such as 2,4-dihydro-5-methyl-2-(2,4,6-trichlorophenyl)-3H-pyrazol-3-one, 2,4-dihydro-5-methyl-2-(2,3,4,5,6-pentafluorophenyl)-3H-pyrazol-3-one, 2,4-dihydro-5-methyl-2-(2-trifluoroethylphenyl)-3H-pyrazol-3-one and the corresponding zinc salts derived therefrom. Other examples include charge control agents with one or more acidic functional groups, such as fumaric acid, malic acid, adipic acid, terephthalic acid, salicylic acid, fumaric acid monoethyl ester, copolymers derived from styrene and methacrylic acid, copolymers of styrene and lithium salt of methacrylic acid, 5,5'-methylenedisalicylic acid, 3,5-di-t-butylbenzoic acid, 3,5-di-t-butyl-4-hydroxybenzoic acid, 5-t-octylsalicylic acid, 7-t-butyl-3-hydroxy-2-napthoic acid, and combinations thereof. Still other acidic charge control agents which are considered to fall within the scope of the invention include N-acylsulfonamides, such as, N-(3,5-di-t-butyl-4-hydroxybenzoyl)-4-chlorobenzenesulfonamide and 1,2-benzisothiazol-3(2H)-one 1,1-dioxide. Another class of useful charge control agents include, but are not limited to, iron organo metal complexes such as organo iron complexes, for example T77 from Hodogaya. Still another useful charge control agent is a quaternary ammonium functional acrylic polymer.

Useful charge control agents include alkyl pyridinium halides such as cetyl pyridinium halide, cetyl pyridinium tetrafluoroborates, quaternary ammonium sulfate, and sulfonate charge control agents as described in U.S. Pat. No. 4,338,390 (Lu Chin) that is incorporated herein by reference, stearyl phenethyl dimethyl ammonium tosylates, distearyl dimethyl ammonium methyl sulfate, and stearyl dimethyl hydrogen ammonium tosylate.

One or more charge control agents can be present in the fluorescing yellow polymeric toner particles in an amount to provide a consistent level of charge of at least −40 μCoulomb/g to and including −75 μCoulomb/g, when charged, particularly for toner particles having a $D_{vol}$ of 8 μm. Examples of suitable amounts include at least 0.1 weight % and up to and including 10 weight %, based on the total fluorescing yellow polymeric toner particle dry weight.

Useful waxes (can also be known as lubricants) that can be present in the fluorescing yellow polymeric toner particles include low molecular weight polyolefins (polyalkylenes) such as polyethylene, polypropylene, and polybutene, such as Polywax 500 and Polywax 1000 waxes from Peterolite, Clariant PE130 and Licowax PE190 waxes from Clariant Chemicals, and Viscol 550 and Viscol 660 waxes from Sanyo. Also useful are ester waxes that are available from Nippon Oil and Fat under the WE-series. Other useful waxes include silicone resins that can be softened by heating, fatty acid amides such as oleamide, erucamide, ricinoleamide, and stearamide, vegetable waxes such as carnauba wax, rice wax, candelilla wax, Japan wax, and jojoba wax, animal waxes such as bees wax, mineral and petroleum waxes such as montan wax, ozocerite, ceresine, paraffin wax, microcrystalline wax, and Fischer-Tropsch wax, and modified products thereof. Irrespective to the origin, waxes having a melting point in the range of at least 30° C. and up to and including 150° C. are useful. One or more waxes can be present in an amount of at least 0.1 weight % and up to and including 20 weight %, or at least 1 weight % and up to and including 10 weight %, based on the total fluorescing yellow polymeric toner particle weight. These waxes, especially the polyolefins, can be used also as fuser release aids. In some embodiments, the fuser release aids are waxes having 70% crystallinity as measured by differential scanning calorimetry (DSC).

In general, a useful wax has a number average molecular weight ($M_n$) of at least 500 and up to and including 7,000. Polyalkylene waxes that are useful as fuser release aids can have a polydispersity of at least 2 and up to and including 10 or typically of at least 3 and up to and including 5. Polydispersity is a number representing the weight average molecular weight ($M_w$) of the polyalkylene wax divided by its number average molecular weight ($M_n$).

Useful flow additive particles that can be present inside or on the outer surface of the fluorescing yellow polymeric toner particles include but are not limited to, a metal oxide such as hydrophobic fumed silica particles. Alternatively, the flow additive particles can be both incorporated into the fluorescing yellow polymeric toner particles and on their outer surface. In general, such flow additive particles have an average equivalent spherical diameter (ESD) of at least 5 nm and are present in an amount of at least 0.01 weight % and up to and including 10 weight %, based on the total fluorescing yellow polymeric toner particle weight.

Surface treatment agents can also be on the outer surface of the fluorescing yellow polymeric toner particles in an amount sufficient to permit the fluorescing yellow polymeric toner particles to be stripped from carrier particles in a dry two-component developer by electrostatic forces associated with the charged image or by mechanical forces. Surface fuser release aids can be present on the outer surface of the fluorescing yellow polymeric toner particles in an amount of at least 0.05 weight % and up to and including 1 weight %, based on the total dry weight of fluorescing yellow polymeric toner particles. These materials can be applied to the outer surfaces of the fluorescing yellow polymeric toner particles using known methods for example by powder mixing techniques.

Spacing treatment agent particles ("spacer particles") can be attached to the outer surface by electrostatic forces or physical means, or both. Useful surface treatment agents include but are not limited to, silica such as those commercially available from Degussa as R972 and RY200 or from Wasker as H2000. Other suitable surface treatment agents include but are not limited to, titania, aluminum, zirconia, or other metal oxide particles, and polymeric beads all generally having an ECD of less than 1 μm. Mixtures of these materials can be used if desired, for example a mixture of hydrophobic silica and hydrophobic titania particles.

Some embodiments of the fluorescing yellow polymeric toner particles have the following features:

one or more non-fluorescing yellow colorants selected from group consisting of coumarins, naphthalimides, perylenes, and anthrones, one or more fluorescing yellow colorants selected from the group consisting of coumarins, naphthalimides, perylenes, and anthrones, the one or more non-fluorescing yellow colorants and one or more fluorescing yellow colorants, independently have one or more absorbance peak wavelengths of at least 470 nm and up to and including 580 nm, the total covering power ratio of the fluorescing yellow polymeric toner particles to non-fluorescing yellow polymeric toner particles having the same composition, porosity, and size, but from which the fluorescing yellow colorants are absent, is at least 2:1 and up to and including 8:1, and a mean volume weighted diameter ($D_{vol}$) before fixing of at least 4 μm and up to and including 15 μm.

Preparation of Polymeric Toner Particles

The fluorescing yellow polymeric toner particles of this invention can be prepared using any suitable manufacturing procedure wherein the appropriate fluorescing yellow colorants and non-fluorescing colorants are incorporated within the particles. Such manufacturing methods include but are not limited to, melt extrusion methods, coalescence, spray drying, and other chemical techniques. The fluorescing yellow polymeric toner particles can be prepared as "chemically prepared toners", "polymerized toners", or "in-situ toners". They can be prepared using controlled growing instead of grinding. Various chemical processes include suspension polymers, emulsion aggregation, micro-encapsulation, dispersion, and chemical milling. Details of such processes are described for example in the literature cited in [0010] of U.S. Patent Application Publication 2010/0164218 (Schulze-Hagenest et al.) the disclosure of which is incorporated herein by reference. The fluorescing yellow polymeric toner particles can also be prepared using limited coalescence process as described in U.S. Pat. No. 5,298,356 (Tyagi et al.) the disclosure of which is incorporated herein by reference, or a water-in-oil-in-water double emulsion process as described in U.S. Patent Application Publication 2011/0262858 (Nair et al.) the disclosure of which is incorporated herein by reference, especially if porosity is desired in the fluorescing yellow polymeric toner particles. Another method for preparing the fluorescing yellow polymeric toner particles is by a spray/freeze drying technique as described in U.S. Patent Application Publication 2011/0262654 (Yates et al.) the disclosure of which is incorporated herein by reference.

In a particularly useful manufacturing method, a desired polymer binder (or mixture of polymeric binders) for use in the fluorescing yellow polymeric toner particles is produced independently using a suitable polymerization process known in the art. The one or more polymeric binders are dry blended or mixed as polymeric resin particles with one or more fluorescing yellow colorants and one or more non-fluorescing yellow colorants (pigments or dyes) to form a dry blend. The optional additives, such as charge control agents, waxes, fuser release aids, and colorants can be also incorporated into the dry blend with the three essential components. The amounts of the essential and optional components can be adjusted in the dry blend in a suitable manner that a skilled worker would readily understand to provide the desired amounts in the resulting fluorescing yellow polymeric toner particles. The conditions for mechanical dry blending are known in the art.

The dry blend is then melt processed in a suitable apparatus such as a two-roll mill or hot-melt extruder. In some embodiments, the dry melt is extruded under low shear conditions in an extrusion device to form an extruded composition. However, these low shear conditions are not always required. The melt processing time can be from 1 minute and up to and including 60 minutes, and the time can be adjusted by a skilled worker to provide the desired melt processing temperature and uniformity in the resulting extruded composition.

For example, it is useful to melt extrude a dry blend of the noted components that has a viscosity of at least 90 pascals sec and up to and including 2300 pascals sec, or typically of at least 150 pascals sec and up to and including 1200 pascals sec.

Generally, the dry blend is melt extruded in the extrusion device at a temperature higher than the glass transition temperature of the one or more polymeric binders used to form the polymeric binder phase, and generally at a temperature of at least 90° C. and up to and including 240° C. or typically of at least 120° C. and up to and including 160° C. The temperature results, in part, from the frictional forces of the melt extrusion process.

The resulting extruded composition (sometimes known as a "melt product" or a "melt slab") is generally cooled, for example, to room temperature, and then broken up (for example pulverized) into fluorescing yellow polymeric toner particles having the desired $D_{vol}$ as described above. It is generally best to first grind the extruded composition prior to a specific pulverizing operation. Grinding can be carried out using any suitable procedure. For example, the extruded composition can be crushed and then ground using for example a fluid energy or jet mill as described for example in U.S. Pat. No. 4,089,472 (Seigel et al.) the disclosure of which is incorporated by reference. The particles are then further reduced in size by using high shear pulverizing devices such as a fluid energy mill, and then classified as desired.

The resulting fluorescing yellow polymeric toner particles can then be surface treated with suitable hydrophobic flow additive particles having an equivalent circular diameter (ECD) of at least 5 nm to affix such hydrophobic flow additive particles on the outer surface of the particles. These hydrophobic flow additive particles can be composed of metal oxide particles such as hydrophobic fumed oxides such as silica, alumina, or titania in an amount of at least 0.01 weight % and up to and including 10 weight % or typically at least 0.1 weight % and up to and including 5 weight %, based on the total visible fluorescing magenta dry toner particle weight.

In particular, a hydrophobic fumed silica such as R972 or RY200 (from Nippon Aerosil) can be used for this purpose, and the amount of the fumed silica particles can be as noted above, or more typically at least 0.1 weight % and up to and including 3 weight %, based on the total fluorescing yellow polymeric toner particle weight.

The hydrophobic flow additive particles can be added to the outer surface of the fluorescing yellow polymeric toner particles by mixing both types of particles in an appropriate mixer.

The resulting treated fluorescing yellow polymeric toner particles can be classified (sieved) through a 230 mesh vibratory sieve to remove non-attached silica particles and silica agglomerates and any other components that may not have been incorporated into the fluorescing yellow polymeric toner particles. The temperature during the surface treatment can be controlled to provide the desired attachment and blending.

Non-fluorescing yellow, cyan, magenta, and black polymeric toner particles useful in the practice of this invention can be prepared in various ways as described above, including the melt extrusion processes described above for the fluorescing yellow polymeric toner particles, but with the incorporated non-fluorescing colorants that are well known in the art.

The various non-fluorescing polymeric color toner particles can be prepared using a suitable polymeric binder phase comprising one or more polymeric binders (as described above) and one or more of non-fluorescing cyan, non-fluorescing yellow, non-fluorescing magenta, or non-fluorescing black colorants. For example, such colorants can be in principle any of the colorants described in the Colour Index, Vols. I and II, $2^{nd}$ Edition (1987) or in the Pantone® Color Formula Guide, $1^{st}$ Edition, 2000-2001. The choice of particular non-fluorescing colorants for the cyan, yellow, magenta, and black (CYMK) color toners is well described in the art, for example in the proceedings of IS&T NIP 20: International Conference on Digital Printing Technologies, IS&T: The Society for Imaging Science and Technology, 7003 Kilworth Lane, Springfield, Va. 22151 USA ISBM: 0-89208-253-4, p. 135. Carbon black is generally useful as the black toner colorant while other colorants for the CYM color toners include but are not limited to, red, blue, and green pigments, respectively. Specific colorants can include copper phthalocyanine and Pigment Blue that can be obtained as Lupreton Blue™ SE1163.

The amount of one or more non-fluorescing colorants in the non-fluorescing polymeric color toners can vary over a wide range and a skilled worker in the art would know how to pick the appropriate amount for a given non-fluorescing colorant or mixture of colorants. In general, the total non-fluorescing colorants in each non-fluorescing polymeric color toner can be at least 1 weight % and up to and including 40 weight %, or typically at least 3 weight % and up to and including 25 weight %, based on the total polymeric color toner weight. The non-fluorescing colorant in each non-fluorescing color toner can also have the function of providing charge control, and a charge control agent (as described above) can also provide coloration. All of the optional additives described above for the fluorescing yellow polymeric toner particles used in this invention can likewise be used in the non-fluorescing polymeric color toners.

Developers

The fluorescing yellow polymeric toner particles of this invention can be used as a dry mono-component developer, or combined with carrier particles to form dry two-component developers. In all of these embodiments, a plurality (usually thousands or millions) of individual fluorescing yellow polymeric toner particles are used together.

Such dry mono-component or dry two-component developers generally comprise a charge control agent, wax, lubricant, fuser release aid, or any combination of these materials within the fluorescing yellow polymeric toner particles, or they can also include flow additive particles on the outer surface of the particles. Such components are described above.

Useful dry one-component developers generally include the fluorescing yellow polymeric toner particles as the sole essential component. Dry two-component developers generally comprise carrier particles (also known as carrier vehicles) that are known in the electrophotographic art and can be selected from a variety of materials. Carrier particles can be uncoated carrier core particles (such as magnetic particles) and core magnetic particles that are overcoated with a thin layer of a film-forming polymer such as a silicone resin type polymer, poly(vinylidene fluoride), poly(methyl methacrylate), or mixtures of poly(vinylidene fluoride) and poly (methyl methacrylate).

The amount of fluorescing yellow polymeric toner particles in a two-component developer can be at least 4 weight % and up to and including 20 weight % based on the total dry weight of the two-component dry developer.

Image Formation Using Fluorescing Yellow Polymeric Toner Particles

The fluorescing yellow polymeric toner particles of this invention can be applied to a suitable receiver material (or substrate) of any type using various methods such as a digital printing process such as an electrostatic printing process, or electrophotographic printing process as described in L. B. Schein, *Electrophotography and Development Physics,* $2^{nd}$ Edition, Laplacian Press, Morgan Hill, Calif., 1996 (ISBN 1-885540-02-7), or by an electrostatic coating process as described for example in U.S. Pat. No. 6,342,273 (Handels et al.) the disclosure of which is incorporated herein by reference.

Such receiver materials include, but are not limited to, coated or uncoated papers (cellulosic or polymeric papers), transparent polymeric films, ceramics, paperboard, cardboard, metals, fibrous webs or ribbons, and other substrate materials that would be readily apparent to one skilled in the art. In particular, the receiver materials (also known as the final receiver material or final receiver material) can be sheets of paper or polymeric films that are fed from a supply of receiver materials.

For example, the fluorescing yellow polymeric toner particles can be applied to a receiver material by a digital printing process such as an electrostatic printing process that includes but is not limited to, an electrophotographic printing process, or by a coating process such as an electrostatic coating process including an electrostatic brush coating as described in U.S. Pat. No. 6,342,273 (noted above). In some embodiments, developed latent images can be directly transferred to the "final" receiver element and then fixed to that receiver element.

In one electrophotographic method, one or more latent images (that is an electrostatic latent image) can be formed on a primary imaging member such as a charged photoconductor belt or roller using a suitable light source such as a laser or light emitting diode. The one or more latent images are then developed on the primary imaging member by bringing the latent images into close proximity with a dry one-component or dry two-component developer comprising the fluorescing yellow polymeric toner particles described herein to form a fluorescing yellow toner image (fixed or fused image) on the primary imaging member to provide a covering power in a printed receiver material of at least 300 $cm^2/g$ and up to and including 1300 $cm^2/g$.

In the embodiments of multi-color printing, multiple photoconductors can be used, each developing a separate non-fluorescing color toner image and another for developing the fluorescing yellow polymeric toner image. Alternatively, a single photoconductor can be used with multiple developing stations where after each latent non-fluorescing image and fluorescing yellow toner image is developed, it is transferred to the receiver material, or it is transferred to an intermediate transfer member (belt or rubber) and then to the receiver material after all of the color toner images have been accumulated on the intermediate transfer member.

In some embodiments, it is desirable to develop and fix the latent image with sufficient dry toner particles to form an enhanced composite non-fluorescing developed color toner image wherein the covering power of the fluorescing yellow polymeric toner particles in the enhanced composite non-fluorescing developed color toner image is at least 300 $cm^2/g$ and up to and including 1300 $cm^2/g$, and the covering power of each of the non-fluorescing cyan, non-fluorescing yellow (if present), non-fluorescing magenta, and non-fluorescing black toner particles in the enhanced composite non-fluorescing developed color toner image is at least 1500 $cm^2/g$ and up to and including 2300 $cm^2/g$.

In more particular embodiments, the covering power of the fluorescing yellow polymeric toner particles in the enhanced composite non-fluorescing developed color toner image is at least 600 $cm^2/g$ and up to and including 1300 $cm^2/g$, and the covering power of each of the non-fluorescing cyan, non-fluorescing yellow (if present), non-fluorescing magenta, and non-fluorescing black toner particles in the enhanced composite non-fluorescing developed color toner image is at least 1700 $cm^2/g$ and up to and including 2100 $cm^2/g$.

In other embodiments, the developing is carried out using at least four sequential toner stations, to form in sequence, a non-fluorescing cyan toner image, a fluorescing yellow toner image, a non-fluorescing magenta toner image, and a non-fluorescing cyan toner image, wherein the covering power of the fluorescing yellow polymeric toner particles in the transferred enhanced composite color toner image is at least 600 $cm^2/g$ and up to and including 1300 $cm^2/g$.

In still other embodiments, the developing is carried out using at least three sequential toner stations, to form in sequence, a fluorescing yellow toner image, a non-fluorescing cyan toner image, a non-fluorescing magenta toner image, and a non-fluorescing black toner image, wherein the covering power of the fluorescing yellow polymeric toner particles in the transferred enhanced composite color toner image is at least 300 $cm^2/g$ and up to and including 600 $cm^2/g$.

While a developed dry toner image can be transferred to a final receiver (receiver material) using a thermal or thermal assist process as is known in the art, it is generally transferred using an electrostatic process including an electrophotographic process such as that described in L. B. Schein, *Electrophotography and Development Physics,* $2^{nd}$ Edition, Laplacian Press, Morgan Hill, Calif., 1996. The electrostatic transfer can be accomplished using a corona charger or an electrically biased transfer roller to press the receiver material into contact with the primary imaging member while applying an electrostatic field. In an alternative embodiment, a developed toner image can be first transferred from the primary imaging member to an intermediate transfer member (belt or roller) that serves as a receiver material, but not as the final receiver material, and then transferred from the intermediate transfer member to the final receiver material.

Electrophotographic color printing generally includes subtractive color mixing wherein different printing stations in a given apparatus are equipped with non-fluorescing cyan toner particles, non-fluorescing magenta toner particles, and non-fluorescing black toner particles, in a desired order. It is also possible to have separate printing station with non-fluorescing stations. Thus, a plurality of toner images of different non-fluorescing colors can be applied to the same primary imaging member (such as dielectric member), intermediate transfer member, and final receiver material, including one or more non-fluorescing color toner images in combination with the toner image comprising the fluorescing yellow polymeric toner particles described herein. Such different toner images are generally applied or transferred to the final receiver material in a desired sequence or succession using successive toner application or printing stations as described below.

For example, in some embodiments, the developing to form a composite color toner image is carried out using at least four sequential toner stations, to form in sequence, a non-fluorescing cyan toner image, a fluorescing yellow toner image, a non-fluorescing magenta toner image, and a non-fluorescing black toner image, wherein the covering power of the fluorescing yellow polymeric toner particles in the transferred enhanced composite color toner image (on a receiver material) is at least 600 $cm^2/g$ and up to and including 1300 $cm^2/g$.

In other embodiments of this invention, the developing is carried out using at least three sequential toner stations, to form in sequence, a non-fluorescing yellow toner image, a non-fluorescing cyan toner image, a non-fluorescing magenta toner image, and a fluorescing yellow toner image, wherein the covering power of the fluorescing yellow polymeric toner particles in the transferred enhanced composite color toner image is at least 300 $cm^2/g$ and up to and including 600 $cm^2/g$.

A toner station containing the fluorescing yellow polymeric toner particles can be provided in the imaging method and apparatus in any location in the desired toner printing sequence.

The various transferred toner images are then fixed (thermally fused) on the receiver material in order to permanently affix them to the receiver material. This fixing can be done using various means such as heating alone (non-contact fixing) using an oven, hot air, radiant, or microwave fusing, or by passing the toner image(s) through a pair of heated rollers (contact fixing) to thereby apply both heat and pressure to the toner image(s) containing toner particles. Generally, one of the rollers is heated to a higher temperature and can have an optional release fluid to its surface. This roller can be referred to as the fuser roller, and the other roller is generally heated to a lower temperature and usually serves the function of applying pressure to the nip formed between the rollers as the toner image(s) is passed through. This second roller can be referred to as a pressure roller. Whatever fixing means is used, the fixing temperature is generally higher than the glass transition temperature of the various toner particles, which $T_g$ can be at least 45° C. and up to and including 90° C. or at least 50° C. and up to and including 70° C. Thus, fixing is generally at a temperature of at least 95° C. and up to and including 220° C. or more generally at a temperature of at least 135° C. and up to and including 210° C.

As the developed toner image(s) on the receiver material is passed through the nip formed between the two rollers, the various fluorescing and non-fluorescing dry toner particles in the developed toner image(s) are softened as their temperature is increased upon contact with the fuser roller. The melted toner particles generally remain affixed on the surface of the receiver material.

For example, the method of this invention can comprise:

forming a non-fluorescing cyan toner image, fluorescing yellow toner image, non-fluorescing magenta toner image, and non-fluorescing black dry toner images, in any desired sequence, in a composite fluorescing color image on a receiver material, then fixing all of the color toner images to the receiver material.

It is advantageous that the present invention can be used in a printing apparatus with multiple printing stations, for example where the fluorescing yellow polymeric toner particles can be applied to a receiver material at any printing stations, for example, the second or last second printing station, with composite non-fluorescing color toner images.

A useful printing machine is illustrated in FIG. 1 of the present application. FIG. 1 is a side elevational view schematically showing portions of a typical electrophotographic print engine or printer apparatus suitable for printing of one or more toner images. An electrophotographic printer apparatus 100 has a number of sequentially arranged electrophotographic image forming printing modules M1, M2, M3, M4, and M5. Each of the printing modules generates a single dry toner image for transfer to a receiver material successively moved through the modules. Each receiver material, during a single pass through the five modules, can have transferred in registration thereto up to five single toner images. A composite color toner image formed on a receiver material can comprise combinations or subsets of the CYMK color toner images and the fluorescing yellow polymeric toner particles described herein, on the receiver material over the composite color toner image on the receiver material. In a particular embodiment, printing module M1 forms non-fluorescent black (K) toner color separation images, M2 forms fluorescent or non-fluorescent yellow (Y) toner color separation images, M3 forms non-fluorescent magenta (M) toner color separation images, and M4 forms non-fluorescent cyan (C) toner color separation images. Printing module M5 can form a fluorescing yellow toner image that provides enhancement of the composite color toner image or it can be left empty if M2 contains fluorescent yellow toner particles.

Alternatively, M2 can form a fluorescing yellow image while M5 can be used to form a reduced density black toner image or a reduced density fluorescing or non-fluorescing magenta toner image.

Receiver materials 5 as shown in FIG. 1 are delivered from a paper supply unit (not shown) and transported through the printing modules M1-M5. The receiver materials are adhered [for example electrostatically using coupled corona tack-down chargers (not shown)] to an endless transport web 101 entrained and driven about rollers 102 and 103.

Each of the printing modules M1-M5 includes a photoconductive imaging roller 111, an intermediate transfer roller 112, and a transfer backup roller 113, as is known in the art. For example, at printing module M1, a particular toner separation image can be created on the photoconductive imaging roller 111, transferred to intermediate transfer roller 112, and transferred again to a receiver member 5 moving through a transfer station, which transfer station includes intermediate transfer roller 112 forming a pressure nip with a corresponding transfer backup roller 113.

A receiver material can sequentially pass through the printing modules M1 through M5. In some or all of the printing modules a toner separation image can be formed on the receiver material 5 to provide the desired enhanced composite fluorescing yellow color toner image described herein.

Printing apparatus 100 has a fuser of any well known construction, such as the shown fuser assembly 60 using fuser rollers 62 and 64. Even though a fuser 60 using fuser rollers 62 and 64 is shown, it is noted that different non-contact fusers using primarily heat for the fusing step can be beneficial as they can reduce compaction of toner layers formed on the receiver material 5, thereby enhancing tactile feel.

A logic and control unit (LCU) 230 can include one or more processors and in response to signals from various sensors (CONT) associated with the electrophotographic printer apparatus 100 provides timing and control signals to the respective components to provide control of the various components and process control parameters of the apparatus as known in the art.

Although not shown, the printer apparatus 100 can have a duplex path to allow feeding a receiver material having a fused toner image thereon back to printing modules M1 through M5. When such a duplex path is provided, two sided printing on the receiver material or multiple printing on the same side is possible.

Operation of the printing apparatus 100 will be described. Image data for writing by the printer apparatus 100 are received and can be processed by a raster image processor (RIP), which can include a color separation screen generator or generators. The image data include information to be formed on a receiver material, which information is also processed by the raster image processor. The output of the RIP can be stored in frame or line buffers for transmission of the color separation print data to each of the respective printing modules M1 through M5 for printing color separations in the desired order. The RIP or color separation screen generator can be a part of the printer apparatus or remote therefrom. Image data processed by the RIP can at least partially include data from a color document scanner, a digital camera, a computer, a memory or network. The image data typically include image data representing a continuous image that needs to be reprocessed into halftone image data in order to be adequately represented by the printer.

While these embodiments refer to a printing machine comprising five sets of single toner image producing or printing stations or modules arranged in tandem (sequence), a printing machine can be used that includes more or less than five printing stations to provide an enhanced (fluorescing yellow) composite color toner image on the receiver material with five different toner images. Useful printing machines also include other electrophotographic writers or printer apparatus.

The present invention provides at least the following embodiments and combinations thereof, but other combinations of features are considered to be within the present invention as a skilled artisan would appreciate from the teaching of this disclosure:

1. A fluorescing yellow polymeric toner particle comprising a polymeric binder phase, and having distributed therein:

one or more non-fluorescing yellow colorants having one or more absorbance peak wavelengths of at least 480 nm and up to and including 600 nm, and one or more fluorescing yellow colorants having one or more emission peak wavelengths of at least 480 nm and up to and including 600 nm, wherein the molar ratio of the one or more fluorescing yellow colorants to the one or more non-fluorescing yellow colorants is such that the covering power of the fluorescing yellow polymeric toner particle is greater than the covering power of non-fluorescing yellow polymeric toner particles having the same composition and size except that the one or more fluorescing yellow colorants are absent.

2. A fluorescing yellow polymeric toner particle comprising a polymeric binder phase, and having distributed therein:

one or more non-fluorescing yellow colorants having one or more absorbance peak wavelengths of at least 480 nm and up to and including 600 nm, and one or more fluorescing yellow colorants having one or more emission peak wavelengths of at least 480 nm and up to and including 600 nm, wherein the molar ratio of the one or more fluorescing yellow colorants to the one or more non-fluorescing yellow colorants is such that the L* value of the one or more non-fluorescing yellow colorants, when present in a non-fluorescing yellow polymeric toner particle comprising the same polymeric binder phase, is increased by at least 50% in the presence of the one or more fluorescing yellow colorants in the non-fluorescing yellow polymeric toner particle.

3. The fluorescing yellow polymeric toner particle of embodiment 1 or 2, wherein the one or more non-fluorescing yellow colorants are selected from group consisting of coumarins, naphthalimides, perylenes, and anthrones.

4. The fluorescing yellow polymeric toner particle of embodiment 1 or 3, wherein the one or more fluorescing yellow colorants are selected from the group consisting of coumarins, naphthalimides, perylenes, and anthrones.

5. The fluorescing yellow polymeric toner particle of any of embodiments 1 to 4, wherein the polymeric binder phase comprises one or more polyesters or styrene-acrylate copolymers.

6. The fluorescing yellow polymeric toner particle of any of embodiments 1 to 5 having a mean volume weighted diameter ($D_{vol}$) before fixing of at least 4 μm and up to and including 15 μm.

7. The fluorescing yellow polymeric toner particle of any of embodiments 1 to 6, wherein the molar ratio of the one or more fluorescing yellow colorants to the one or more non-fluorescing yellow colorants is such that the covering power of the fluorescing yellow polymeric toner particle to the covering power of the non-fluorescing yellow polymeric toner particles having the same composition and size except that the one or more fluorescing yellow colorants are absent, is at least 1:1 and up to and including 10:1.

8. The fluorescing yellow polymeric toner particle of any of embodiments 1 to 7, wherein the total amount of the one or more non-fluorescing yellow colorants is up to and including 40% of the total amount of the one or more fluorescing yellow colorants, by weight.

9. The fluorescing yellow polymeric toner particle of any of the embodiments 1 to 8, wherein:

the one or more non-fluorescing yellow colorants are selected from group consisting of coumarins, naphthalimides, perylenes, and anthrones, the one or more fluorescing yellow colorants are selected from the group consisting of coumarins, naphthalimides, perylenes, and anthrones, the one or more non-fluorescing yellow colorants and one or more fluorescing yellow colorants, independently have one or more absorbance emission wavelengths of at least 480 nm and up to and including 580 nm, the molar ratio of the one or more fluorescing yellow colorants to the one or more non-fluorescing yellow colorants is such that the covering power of the fluorescing yellow polymeric toner particle is greater than the covering power of non-fluorescing yellow polymeric toner particles having the same composition and size except that the one or more fluorescing yellow colorants are absent, is at least 2:1 and up to and including 8:1, and the fluorescing yellow polymeric toner particle has a mean volume weighted diameter ($D_{vol}$) before fixing of at least 4 μm and up to and including 15 μm.

10. A two-component developer comprising carrier particles and one or more of the fluorescing yellow polymeric toner particles of any of embodiments 1 to 9.

11. A method for providing an enhanced yellow toner image, the method comprising:

providing fluorescing yellow polymeric toner particles on a receiver material to provide a fluorescing yellow toner image, fixing the fluorescing yellow toner image to the receiver material to form a fixed fluorescing yellow toner image, wherein each fluorescing yellow polymeric toner particle is one of embodiments 1 to 9.

12. A method for providing an enhanced yellow toner image, the method comprising:

developing a latent image with fluorescing yellow polymeric toner particles to form a fluorescing yellow toner image on a first receiver material, transferring the fluorescing yellow toner image from the first receiver material to a final receiver material to form a transferred fluorescing yellow toner image, and fixing the transferred fluorescing yellow toner image to the final receiver material to form a fixed fluorescing yellow toner image, wherein each fluorescing yellow polymeric toner particle is one of embodiments 1 to 9.

13. The method of embodiment 11 or 12, wherein the covering power of the fluorescing yellow polymeric toner particles in the fixed fluorescing yellow toner image is at least 300 $cm^2/g$ and up to and including 1300 $cm^2/g$.

14. The method of any of embodiments 11 to 13, wherein the receiver material or final receiver material is a sheet of paper or a polymeric film.

15. The method of any of embodiments 11 to 14, comprising:

forming one or more latent images, developing the one or more latent images, to form a fluorescing yellow toner image, non-fluorescing cyan toner image, non-fluorescing magenta toner image, and non-fluorescing black toner image, to form a composite fluorescing color toner image, transferring the composite fluorescing composite color toner image to the final receiver material to form a transferred composite fluorescing color toner image, and fixing the transferred composite fluorescing color toner image to the receiver material.

16. The method of embodiment 15, wherein the developing is carried out using at least four sequential toner stations, to form in sequence, a non-fluorescing cyan toner image, a fluorescing yellow toner image, a non-fluorescing magenta toner image, and a non-fluorescing cyan toner image, wherein the covering power of the fluorescing yellow polymeric toner particles in the transferred enhanced composite color toner image is at least 600 $cm^2/g$ and up to and including 1300 $cm^2/g$.

17. The method of embodiment 15, wherein the developing is carried out using at least three sequential toner stations, to form in sequence, a fluorescing yellow toner image, a non-fluorescing cyan toner image, a non-fluorescing magenta toner image, and a non-fluorescing black toner image, wherein the covering power of the fluorescing yellow polymeric toner particles in the transferred enhanced composite color toner image is at least 300 $cm^2/g$ and up to and including 600 $cm^2/g$.

18. A printed receiver material provided by the method of any of embodiments 11 to 17, comprising a printed fluorescing yellow color toner image comprising fused fluorescing yellow polymeric toner particles.

19. The printed receiver material of embodiment 18, wherein the covering power of the fused fluorescing yellow polymeric toner particles in the fluorescing yellow color toner image is at least 300 $cm^2/g$ and up to and including 1300 $cm^2/g$.

The following Examples are provided to illustrate the practice of this invention and are not meant to be limiting in any manner.

Fluorescent yellow and non-fluorescent yellow toner particles were prepared using a polymeric binder resins particles that were melt processed in a two roll mill or extruder with appropriate colorants and addenda. A preformed mechanical blend of particulate polymer resin particles, colorants, and toner additives (all described below) were prepared and then roll milled or extruded. Roll milling, extrusion, or other melt processing was performed at a temperature sufficient to achieve a uniform melt processed composition. This composition, referred to as a "melt product" or "melt slab" was then cooled to room temperature. For a polymeric binder having a $T_g$ in the range of from 50° C. to 120° C., or a $T_m$ in the range of from 65° C. to 200° C., a melt blending temperature of from 90° C. to 240° C. was suitable using a roll mill or extruder. The melt blending times (that is, the exposure period for melt blending at elevated temperature) was in the range of from 1 minute to 60 minutes.

The components were dry powder blended in a 40 liter Henschel mixer for 60 seconds at 1000 RPM to produce a homogeneous dry blend that was then melt compounded in a twin screw co-rotating extruder to melt the polymer binder and disperse the pigments, charge agents, and waxes uniformly within the resulting polymeric binder phase. Melt compounding was done at a temperature of 110° C. at the extruder inlet, increasing to 196° C. in the extruder compounding zones, and 196° C. at the extruder die outlet. The melt extrusion conditions were a powder blend feed rate of 10 kg/hr and an extruder screw speed of 490 RPM. The extruded composition (extrudate) was cooled to room temperature and then broken into about 0.32 cm size granules.

These granules were then finely ground in an air jet mill to a $D_{vol}$ of 8 μm as determined using a Coulter Counter Multisizer. The finely ground toner particles were then classified in a centrifugal air classifier to remove very small particles and fines that were not desired in the finished dry toner composition. After classification, the toner particles had a particle size distribution with a width, expressed as the diameter at the 50% percentile/diameter at the 16% percentile of the cumulative particle number versus particle diameter, of 1.30 to 1.35.

The classified toner particles were then surface treated with fumed hydrophobic silica (Aerosil® R972 from Nippon Aerosil) wherein 2000 grams of toner particles were mixed with 20 grams of the fumed hydrophobic silica so that 1 weight % silica was attached to the toner particles, based on total toner particle weight using a 10 liter Henschel mixer with a 3-element impeller for 2 minutes at 2000 RPM.

The silica surface-treated toner particles were sieved using a 300 mesh vibratory sieve to remove non-dispersed silica agglomerates and any toner particle flakes that may have formed during the surface treatment process.

The melt extrusion composition was cooled and then pulverized to a $D_{vol}$ of from about 5 μm to about 20 μm. It is generally preferred to first grind the melt extrusion composition prior to a specific pulverizing operation using any convenient grinding procedure. For example, the solid melt extrusion composition can be crushed and then ground using, for example, a fluid energy or jet mill, such as described in U.S. Pat. No. 4,089,472 (noted above) and the ground particles can then be classified in one or more steps. If necessary, the size of the particles can be further reduced by use of a high shear pulverizing device such as a fluid energy mill and classified again.

Two-component electrographic developers were prepared by mixing toner particles prepared as described above with hard magnetic ferrite carrier particles coated with silicone resin as a concentration of 8 weight % toner particles and 92 weight % carrier particles.

EXAMPLES 1-5

Each of several fluorescing yellow dry toner formulations was made using 10,000 g of Reichhold Atlac 382 ES polyester resin, 2200 g of Dayglo HMS-34 Strong fluorescing yellow colorant (amount in TABLE I below), 300 g of Sun Predosol PY 185 Masterbatch (Sun Chemicals), and 293 g of Orient Bontron E-84 charge control agent (Orient Chemicals). A Control fluorescing yellow dry toner formulation was similarly prepared but without the non-fluorescing yellow colorant.

For each formulation, the components were dry blended using a 40 liter Henschel mixer for 60 seconds at 1000 RPM to produce a homogeneous dry blend. The dry blend was then melt compounded in a twin screw co-rotating extruder to melt the polymer binder and disperse the fluorescing colorant, and charge control agent at a temperature of 110° C. at the extruder inlet, 110° C. increasing to 196° C. in the extruder compounding zones, and 196° C. at the extruder die outlet. The processing conditions were a powder blend feed rate of 10 kg/hr and an extruder screw speed of 490 RPM. The cooled extrudate was then chopped to approximately 0.32 cm size granules.

These granules were then finely ground in an air jet mill to an 8 μm $D_{vol}$ as measured using a Coulter Counter Multisizer. The finely ground toner particles were then classified in a centrifugal air classifier to remove very small toner particles and toner fines that are not desired. After this classification, the fluorescing yellow toner product had a particle size distribution with a width, expressed as the diameter at the 50% percentile/diameter at the 16% percentile of the cumulative particle number versus $D_{vol}$ of 1.30 to 1.35.

The classified toner was then surface treated with fumed silica, a hydrophobic silica (Aerosil® R972 manufactured by Nippon Aerosil) by mixing 2000 g of the fluorescing yellow dry toner particles with 20 g of the silica to give a dry toner product containing 1.0 weight % silica in a 10 liter Henschel mixer with a 4 element impeller for 2.5 minutes at 3000 RPM. The silica surface-treated fluorescing yellow toner particles were sieved through a 300 mesh vibratory sieve to remove non-dispersed silica agglomerates and any toner flakes that may have formed during the surface treatment process.

A two-component dry developer was prepared by combining 100 g of the each formulation of fluorescent or non-fluorescent toner particles with 1200 g of carrier particles comprising strontium ferrite cores that had been coated at 230° C. with 0.75 parts of poly(vinylidene fluoride) (Kynar™ 301F manufactured by Pennwalt Corporation) and 0.50 parts of poly(methyl methacrylate) (Soken 1101 distributed by Esprix Chemicals).

Each two-component dry developer was then used in the second printing station (toner imaging unit) of a NexPress™ 3000 Digital Color Printing Press containing non-fluorescing cyan, fluorescing yellow, non-fluorescing magenta, and non-fluorescing black toner particles in sequence in the four printing stations. After application of the various dry toner particles to paper sheets as the receiver material, and fixing, the covering power for these non-fluorescing color toners was measured at 1650 $cm^2/g$, 1700 $cm^2/g$, 2200 $cm^2/g$, and 1800 $cm^2/g$, respectively, in the resulting composite fluorescent color toner image. The covering power of the fluorescing yellow dry toner particles in the printed fluorescing yellow highlights was measured at 1350 $cm^2/g$.

INVENTION EXAMPLES 6-11

Orient Bontron E-64 (2 g) charge control agent was dry blended with 100 g of Reichhold Atlac 382 ES polyester resin binder polymer, and various amounts of fluorescing and non-fluorescing yellow PY 185 pigment Masterbatches. The uniform blend was placed on a 2-roll mill at 120° C. for twenty minutes. The entire milled mass was removed from the rolls while at the noted temperature and allowed to cool to room temperature. The resulting slab was coarse ground and then pulverized in a fluid energy mill, equipped with a cyclone, to a final particle size of 8 μm.

The fluorescent yellow and non-fluorescent yellow toner particles prepared as described above and used in various printing operations are described in the following TABLE I.

TABLE I

| Example | Non-fluorescing Yellow | Amount of Fluorescing Yellow | Amount of non-Fluorescing Yellow | Covering Power ($cm^2/g$) |
|---|---|---|---|---|
| 1 (Control) | None | 2200 | 0 | 625 |
| 2 (Invention) | PY 185 | 2200 | 300 | 1350 |
| 3 (Invention) | PY 185 | 2200 | 600 | 1675 |
| 4 (Invention) | PY 74 | 2200 | 600 | 1200 |
| 5 (Invention) | PY 180 | 2200 | 600 | 1430 |
| 6 (Control) | PY185 | 31.24 | 0 | 1100 |
| 7 (Invention) | PY185 | 25 | 2 | 1315 |
| 8 (Invention) | PY185 | 18.8 | 4 | 1500 |
| 9 (Invention) | PY185 | 12.5 | 6 | 1900 |
| 10 (Invention) | PY185 | 6.25 | 8 | 2250 |
| 11 (Control) | PY185 | 0 | 10 | 2700. |

The resulting printed fluorescent yellow toner images displayed a bright appearance which was eye-catching and striking. In addition, the color details were also found to be greatly improved. It was apparent that by addition of the fluorescent yellow component to the toner particles, much of the color gamut was being achieved. Furthermore, by using a mixture of fluorescing and non-fluorescing yellow pigments, the other toner colors that were produced by mixing the fluorescing yellow colorant with other subtractive primary colors, no unwanted fluorescing was observed in those other colored toners that were produced using the present invention.

The Color Properties of the 2-roll mill toner samples of Examples 6-11, were measured using a Spectrolino unit and the results of the colorimetric values are summarized below in TABLE II. To make the necessary measurements, a uniform $D_{max}$ patch was prepared over a LustroGloss 118 g paper onto which a uniform laydown of 0.45 $mg/cm^2$ was developed. The toner particles on the patch were then fixed by passing the patch through a pair of heated roller moving at 4 inches/second (10.2 cm/sec) at 135° C.

The L*, a*, b* represent the CIELAB 1976 spectral values as described above. The c and h values represent chroma and hue (angle), respectively, as determined using CIELAB 1976 spectral values. Density was also determined using the Spectrolino unit.

As the results in TABLE II indicate, as the amount of non-fluorescing yellow colorant (pigment) was increased in the toner formulations, the visual density increased. However, the visual brightness, as partially indicated by the L* values, was the highest when the concentration of the fluorescing yellow colorant (pigment) was at maximum. Even though the visual density was measured to be low, the color perception indicated that the density achieved for the fluorescing yellow was more than adequate. In order to ensure that production of unwanted colors were avoided, when the yellow toner was mixed with other subtractive primary toner colors such as magenta and cyan, it was found beneficial to reduce the fluorescence of the yellow colorant. When just the concentration of the fluorescing yellow colorant was decreased, the visual density dropped as well as the covering power of the yellow toner samples. Much more pleasing results were obtained when some non-fluorescing yellow colorant was substituted for some of the fluorescing yellow colorant in the toner particles. The results show that with a small addition of the non-fluorescing yellow colorant, lightness values, as measured by the L*, was not greatly sacrificed. However, when it is desired to take advantage of the higher chroma (c), then higher amount of non-fluorescing yellow colorant could be used. The colorimetric results shown in TABLE II show that by combining the fluorescing yellow colorant and the non-fluorescing yellow colorant in particular amounts, the chroma (c) and the b* values of the resulting toner particles (Control Examples 8 and 9) were unexpectedly higher than the chroma (c) and b* values of toner particles prepared using each colorant individually (Invention Examples 6 and 11). Moreover, by selecting proper fluorescing yellow colorants and non-fluorescing yellow colorants to unique blends, a very precise hue angle can be easily achieved.

TABLE II

| | Example | | | | | |
|---|---|---|---|---|---|---|
| | 6 | 7 | 8 | 9 | 10 | 11 |
| Density | 1.39 | 1.48 | 1.81 | 1.97 | 2.09 | 2.09 |
| L* | 92.76 | 91.55 | 90.7 | 90.22 | 89.46 | 89.23 |
| a* | −7.95 | −6.9 | −5.8 | −6.1 | −6.68 | −8.52 |
| b* | 111.27 | 111.1 | 116.68 | 116.39 | 113.74 | 106.56 |
| c | 111.55 | 111.31 | 116.83 | 116.55 | 113.94 | 106.9 |
| h | 94.09 | 93.56 | 92.84 | 93 | 93.36 | 94.57. |

The invention has been described in detail with particular reference to certain preferred embodiments thereof, but it will be understood that variations and modifications can be effected within the spirit and scope of the invention.

The invention claimed is:

1. A fluorescing yellow polymeric toner particle comprising a polymeric binder phase, and having distributed therein:

one or more non-fluorescing yellow colorants having one or more absorbance peak wavelengths of at least 480 nm and up to and including 600 nm, and one or more fluorescing yellow colorants having one or more emission peak wavelengths of at least 480 nm and up to and including 600 nm, wherein:

the molar ratio of the one or more fluorescing yellow colorants to the one or more non-fluorescing yellow colorants is such that the covering power of the fluorescing yellow polymeric toner particle is greater than the covering power of non-fluorescing yellow polymeric toner particles having the same composition and size except that the one or more fluorescing yellow colorants are absent, the molar ratio of the one or more fluorescing yellow colorants to the one or more non-fluorescing yellow colorants is such that the L* value of the one or more non-fluorescing yellow colorants, when present in a non-fluorescing yellow polymeric toner particle comprising the same polymeric binder phase, is increased by at least 50% in the presence of the one or more fluorescing yellow colorants in the non-fluorescing yellow polymeric toner particle the molar ratio of the one or more fluorescing yellow colorants to one or more non-fluorescing yellow colorants is at least 2:1 and up to 8:1, and the one or more non-fluorescing yellow colorants are selected from group consisting of coumarins, naphthalimides, perylenes, and anthrones.

2. The fluorescing yellow polymeric toner particle of claim 1, wherein the one or more fluorescing yellow colorants are selected from the group consisting of coumarins, naphthalimides, perylenes, and anthrones.

3. The fluorescing yellow polymeric toner particle of claim 1, wherein the polymeric binder phase comprises one or more polyesters or styrene-acrylate copolymers.

4. The fluorescing yellow polymeric toner particle of claim 1 having a mean volume weighted diameter ($D_{vol}$) before fixing of at least 4 μm and up to and including 15 μm.

5. The fluorescing yellow polymeric toner particle of claim 1, wherein the molar ratio of the one or more fluorescing yellow colorants to the one or more non-fluorescing yellow colorants is such that the covering power of the fluorescing yellow polymeric toner particle to the covering power of the non-fluorescing yellow polymeric toner particles having the same composition and size except that the one or more fluorescing yellow colorants are absent, is at least 1:1 and up to and including 10:1.

6. The fluorescing yellow polymeric toner particle of claim 1, wherein the total amount of the one or more non-fluorescing yellow colorants is up to and including 40% of the total amount of the one or more fluorescing yellow colorants, by weight.

7. A two-component developer comprising carrier particles and one or more of the fluorescing yellow polymeric toner particles of claim 1.

8. The fluorescing yellow polymeric toner particle of claim 1, wherein:

the one or more fluorescing yellow colorants are selected from the group consisting of coumarins, naphthalimides, perylenes, and anthrones, the one or more non-fluorescing yellow colorants and one or more fluorescing yellow colorants, independently have one or more absorbance peak wavelengths of at least 480 nm and up to and including 580 nm, and the fluorescing yellow polymeric toner particle has a mean volume weighted diameter ($D_{vol}$) before fixing of at least 4 μm and up to and including 15 μm.

* * * * *